US010918918B2

(12) United States Patent
Abe

(10) Patent No.: US 10,918,918 B2
(45) Date of Patent: Feb. 16, 2021

(54) IRON TYPE GOLF CLUB HEAD

(71) Applicant: Sumitomo Rubber Industries, Ltd., Hyogo (JP)

(72) Inventor: Hiroshi Abe, Kobe (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 16/661,719

(22) Filed: Oct. 23, 2019

(65) Prior Publication Data

US 2020/0129820 A1 Apr. 30, 2020

(30) Foreign Application Priority Data

Oct. 25, 2018 (JP) ..... JP2018-200979

(51) Int. Cl.
*A63B 53/04* (2015.01)

(52) U.S. Cl.
CPC ..... *A63B 53/047* (2013.01); *A63B 53/0408* (2020.08); *A63B 53/0433* (2020.08)

(58) Field of Classification Search
CPC ..... A63B 53/0466; A63B 53/047
USPC ..... 473/324–350
See application file for complete search history.

(56) References Cited

U.S. PATENT DOCUMENTS 5,439,223 A * 8/1995 Kobayashi ..... A63B 53/04 473/334
5,558,332 A * 9/1996 Cook ..... A63B 53/0487 473/252
5,616,086 A * 4/1997 Chappell ..... A63B 60/00 473/290
5,658,209 A * 8/1997 Blakemore ..... A63B 53/04 473/350
6,348,015 B1 * 2/2002 Kosmatka ..... A63B 53/04 473/342
6,565,452 B2 * 5/2003 Helmstetter ..... A63B 53/02 473/342
6,623,374 B1 * 9/2003 Helmstetter ..... A63B 60/00 473/291
6,709,345 B2 * 3/2004 Iwata ..... A63B 53/04 473/291
6,776,726 B2 * 8/2004 Sano ..... A63B 53/04 473/330
6,875,124 B2 * 4/2005 Gilbert ..... A63B 53/04 473/290

(Continued)

FOREIGN PATENT DOCUMENTS

JP H08-112378 A 5/1996
JP 11033145 A * 2/1999

(Continued)

*Primary Examiner* — Alvin A Hunter
(74) *Attorney, Agent, or Firm* — Studebaker & Brackett PC

(57) ABSTRACT

A head includes a hitting face. The hitting face has a face center and a sweet spot. The hitting face has a face height that is denoted by Hf (mm), the face height being measured at a toe-heel direction position of the face center. The sweet spot has a vertical height that is denoted by Hs (mm). The face center has a vertical height that is denoted by Hc (mm). The vertical height Hc is greater than or equal to 20 mm and less than or equal to 26 mm. The face height Hf is greater than or equal to 40 mm and less than or equal to 52 mm. The head satisfies an expression 1 as follows: Hs<0.06*Hf+16 (expression 1). The head is an iron type golf club head.

13 Claims, 5 Drawing Sheets

(56) References Cited

U.S. PATENT DOCUMENTS

| | | | | |
|---|---|---|---|---|
| 7,762,909 | B2 * | 7/2010 | Sugimoto | A63B 60/00 473/346 |
| 8,216,089 | B2 * | 7/2012 | Matsunaga | A63B 53/0466 473/342 |
| 8,721,471 | B2 * | 5/2014 | Albertsen | A63B 53/04 473/328 |
| 9,011,267 | B2 * | 4/2015 | Burnett | A63B 60/00 473/329 |

FOREIGN PATENT DOCUMENTS

| | | | | |
|---|---|---|---|---|
| JP | 11253586 | A * | 9/1999 | |
| JP | 2003126310 | A * | 5/2003 | A63B 53/0466 |
| JP | 2008245708 | A * | 10/2008 | |
| JP | 2009148533 | A * | 7/2009 | |

* cited by examiner

IRON TYPE GOLF CLUB HEAD

This application claims priority on Patent Application No. 2018-200979 filed in JAPAN on Oct. 25, 2018. The entire contents of this Japanese Patent Application are hereby incorporated by reference.

BACKGROUND OF THE INVENTION

Field of the Invention

The present disclosure relates to iron type golf club heads.

Description of the Related Art

The height of the center of gravity of a golf club head can affect ball flight trajectory. JPH8-112378A discloses a golf club set in which a club having a loft angle of 27°±3° includes a head having a center-of-gravity height of 19 mm±3 mm, and the greater the golf club number is, the higher the center-of-gravity height of the head attached to the golf club is.

SUMMARY OF THE INVENTION

An iron club is used mainly for hitting a golf ball placed on the ground (lawn). In other words, an iron club is used mainly for hitting a golf ball that is not teed up. Therefore, in an iron type golf club head (iron head), hitting points tend to be distributed on a lower-side portion of a hitting face. In this regard, the inventor of the present disclosure has found that there is room for improvement in rebound performance of the iron head.

The present disclosure provides an iron type golf club head that is excellent in rebound performance upon actual hitting.

A golf club head according to one aspect includes a hitting face. The hitting face includes a face center and a sweet spot. The hitting face has a face height that is denoted by Hf (mm), the face height Hf being measured at a toe-heel direction position of the face center. The sweet spot has a vertical height that is denoted by Hs (mm). The face center has a vertical height that is denoted by Hc (mm). The vertical height Hc is greater than or equal to 20 mm and less than or equal to 26 mm. The face height Hf is greater than or equal to 40 mm and less than or equal to 52 mm. The golf club head satisfies expression 1 shown below. The golf club head is an iron type head.

$$Hs<0.06*Hf+16 \quad \text{(expression 1)}$$

DESCRIPTION OF THE PREFERRED EMBODIMENTS

Findings as Basis for the Present Disclosure

As described above, hitting points of an iron head are likely to be distributed on a lower-side portion of a hitting face. Lowering the center of gravity of the head makes a sweet spot closer to the hitting points, which allows rebound performance at actual hitting points to be improved.

Meanwhile, the degree of bending caused by hitting is small in the lower-side portion of the hitting face as compared with that of the center portion of the hitting face. For this reason, COR (coefficient of restitution) on the lower-side portion of the hitting face is small. That is, CORs at actual hitting points are disadvantageously low. Conceivable ways for increasing the CORs at the actual hitting points are increasing the maximum value of the CORs or lowering the position of a region where the COR is high. However, the former way may contravene golf rules.

In order to lower the position of the region having a high COR, further lowering the sweet spot and lowering the position of the face center are considered. In order to achieve both of them, it is effective to reduce a face height. However, an excessively small face height makes bending of the hitting face smaller, which reduces the maximum value of the CORs.

Based on the findings described above, the inventor of the present disclosure has found that the CORs at actual hitting points can be increased by optimizing the relationship between a face height Hf and a SS height Hs.

In the present disclosure, the following terms are defined.

[Toe-Heel Direction]

The extending direction of a longest face line is defined as a toe-heel direction.

[Top-Sole Direction]

A direction parallel to a hitting face and perpendicular to the toe-heel direction is defined as a top-sole direction.

[Vertical Direction]

In a head that is in a reference state where the head is placed at a predetermined lie angle and a predetermined loft angle on a horizontal plane, a direction perpendicular to the horizontal plane is defined as a vertical direction.

[Face-Back Direction]

In the head being in the reference state, a direction perpendicular to the toe-heel direction and parallel to the horizontal plane is defined as a face-back direction.

[Face Center]

On the center position in the toe-heel direction of the longest face line, the center position in the top-sole direction of the hitting face is defined as a face center.

[Expected COR]

An expected COR in the present disclosure means a weighted average of CORs which is obtained by taking the distribution of hitting points into consideration. The expected COR reflects rebound performance upon actual hitting. The expected COR can also be interpreted as a coefficient of restitution that is expected to be exhibited in actual hitting. The expected COR will be described later in detail.

Hereinafter, an exemplary embodiment will be described in detail with reference to the drawings.

Figure 1:
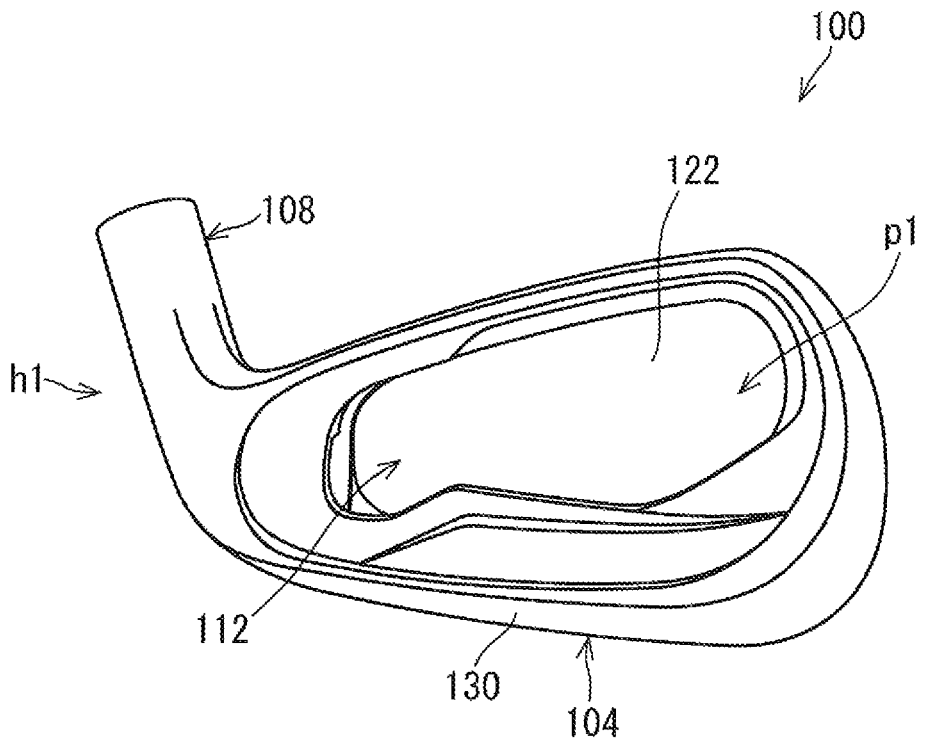
FIG. 1 is a perspective view of a golf club head according to one embodiment.
Figure 2:
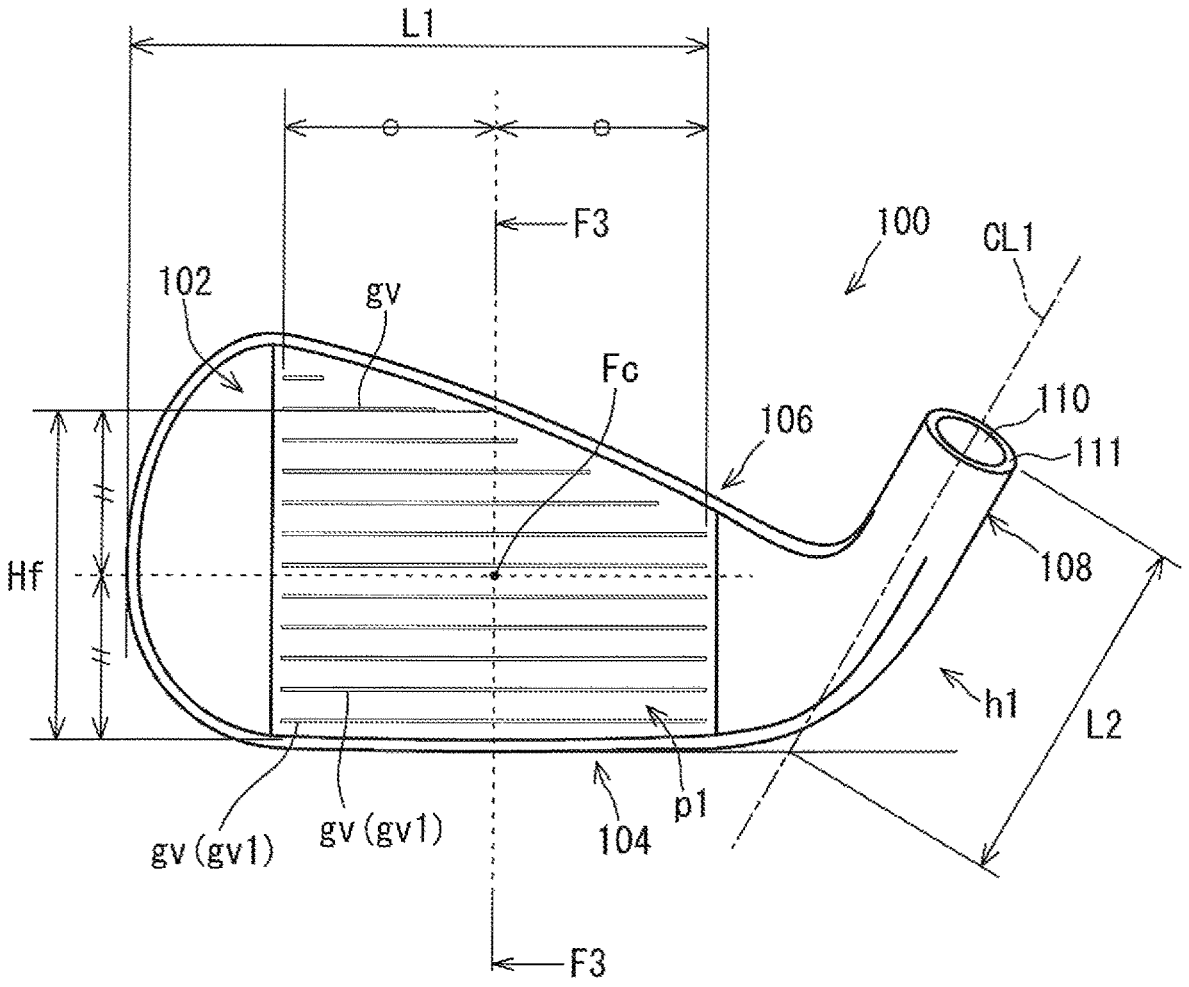
FIG. 2 is a front view of the head in FIG. 1.
Figure 3:
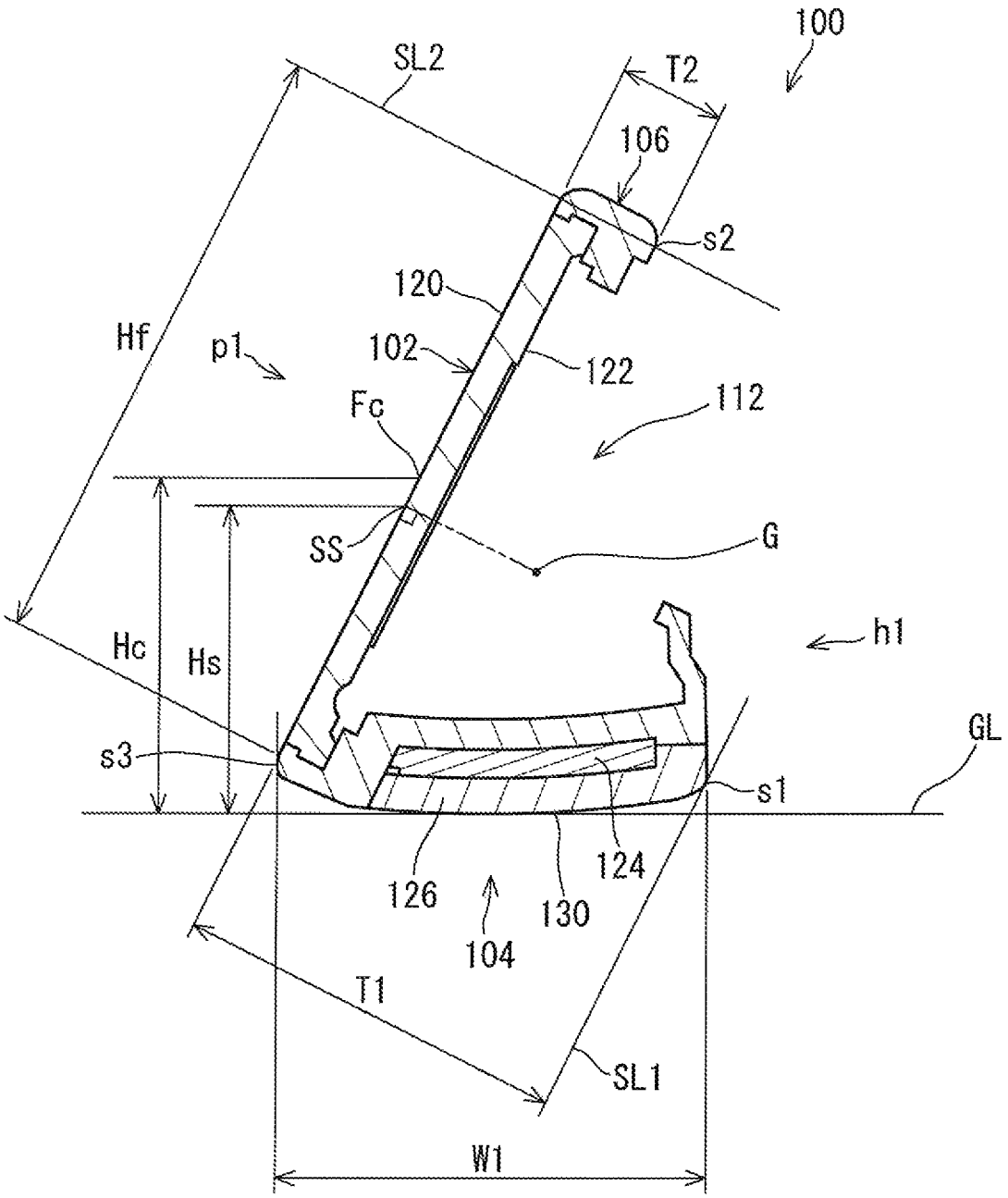
FIG. 3 is a cross-sectional view taken along line F3-F3 in FIG. 2.

FIG. 1 is a perspective view of a head 100 according to one embodiment. FIG. 2 is a front view of the head 100. FIG. 3 is a cross-sectional view taken along line F3-F3 in FIG. 2. The posture of the head 100 shown in FIG. 3 is the reference state in which the head 100 is placed on a horizontal plane GL.

The head 100 includes a hitting face 102, a sole 104, a top surface 106, and a hosel 108. The hosel 108 includes a hosel hole 110 and a hosel end surface 111. A shaft (not shown in the drawings) is inserted to the hosel hole 110. The center line of the hosel hole 110 coincides with the center line of the shaft. In the reference state, the center line of the hosel hole 10 is included in a plane perpendicular to the horizontal plane.

The hitting face 102 includes a plurality of face lines gv. The plurality of face lines gv include a longest face line gv1. The hitting face 102 includes a face center Fc. The hitting face 102 includes a sweet spot SS.

The head 100 is an iron type golf club head. The hitting face 102 is a flat surface. As shown in FIG. 2 and FIG. 3, the head 100 includes a back cavity 12. The head 100 is a cavity back iron.

As shown in the cross-sectional view of FIG. 3, the head 100 includes a head body h1 and a face member p1. In this embodiment, the face member p1 is a plate. The head body h1 includes an opening penetrating through the head body h1, and the face member p1 is attached to the opening. The face member p1 is joined to the head body h1 by welding. The face member p1 includes a front surface 120 forming the hitting face 102. The hitting face 102 includes a portion formed with the face member p1 and a portion formed with the head body h1. All the face lines gv are provided on the front surface 120 the face member p1. The face member p1 includes a rear surface 122 forming a bottom surface of the back cavity 112.

The head body h1 includes a part of the hitting face 102, the entirety of the sole 104, the entirety of the top surface 106, and the entirety of the hosel 108. The head body h1 is integrally formed as a single-piece member. Alternatively, the head body h1 may be formed by combining a plurality of members. The head body h1 forms an annular portion that supports the entire periphery of the face member p1. Further, as shown in FIG. 3, a weight 124 is attached to the head body h1. The weight 124 is located inside the sole 104. The head body h1 further includes a cover 126 which covers the weight 124. The outer surface of the cover 126 forms a part of a sole surface 130. The sole surface 130 is the outer surface of the sole 104. The weight 124 is disposed on the head body h1 and further, the cover 126 is attached to the head body h1 by welding. The weight 124 and the cover 126 may not be present.

As shown in FIG. 3, the head 100 includes a center of gravity G and the sweet spot SS. The center of gravity G of the head 100 is positioned in a space on the back side of the hitting face 102. The sweet spot SS is an intersection point between the hitting face 102 and a straight line that passes the center of gravity G and is perpendicular to the hitting face 102.

Although the center of gravity G of the head (hereinafter, referred to as head gravity center G) and the sweet spot SS are shown in FIG. 3, the head gravity center G and the sweet spot SS are not usually positioned on the cross section of FIG. 3. That is, toe-heel direction positions of the head gravity center G and the sweet spot SS do not usually coincide with the toe-heel direction position of the face center Fc. The head gravity center G and the sweet spot SS are shown in FIG. 3 for the sake of easy understanding.

A double-pointed arrow Hs in FIG. 3 indicates a vertical height of the sweet spot SS. This vertical height is also referred to as an SS height. In the head being in the reference state, the SS height Hs is measured along the vertical direction. That is, the SS height Hs is measured along a direction perpendicular to the horizontal plane GL in the reference state.

A double-pointed arrow Hc in FIG. 3 indicates a vertical height of the face center Fc. In the head being in the reference state, the vertical height Hc of the face center Fc is measured along the vertical direction. That is, the vertical height Hc is measured along the direction perpendicular to the horizontal plane GL.

A double-pointed arrow Hf in FIG. 2 and FIG. 3 indicates the face height. The face height Hf is the height of the hitting face 102 measured at the toe-heel direction position of the face center Fc. The face height Hf is measured along the hitting face 102. The face height Hf is measured along the top-sole direction. The face height Hf is the top-sole direction width of the hitting face 102 which is measured at the toe-heel direction of position of the face center Fc. The hitting face 102 is a flat surface, and the contour of this flat surface is the contour of the hitting face 102.

As described above, hitting points of the iron head are likely to be distributed on the lower side of the hitting face 102. However, it has been discovered that rebound performance at actual hitting points cannot be sufficiently improved by merely lowering the head gravity center G. Even when the sweet spot SS is lowered by lowering the head gravity center G, if bending of the face portion is small, sufficiently high rebound performance cannot be achieved.

The degree of bending caused by hitting is small in the lower-side portion of the hitting face 102 as compared with that of the center portion of the hitting face 102. For this reason, COR (coefficient of restitution) on the lower-side portion of the hitting face 102 is small. Conceivable ways for enhancing rebound performance at actual hitting points are increasing the maximum value of the CORs or lowering the position of the region having a high COR. However, the former way is constrained by the golf rules.

In order to lower the position of the region having a high COR, further lowering the sweet spot SS and lowering the position of the face center Fc are considered. In order to achieve both of them, it is effective to reduce the face height Hf. However, an excessively small face height Hf makes bending of the face portion smaller, which reduces the COR.

From these viewpoints, the inventor of the present disclosure has conducted thorough research for the optimum relationship between the face height Hf and the SS height Hs, and has found the following relational expression. The face height Hf (mm) and the SS height Hs (mm) preferably satisfy the following expression 1.

$$Hs<0.06*Hf+16 \quad \text{(expression 1)}$$

Figure 5:
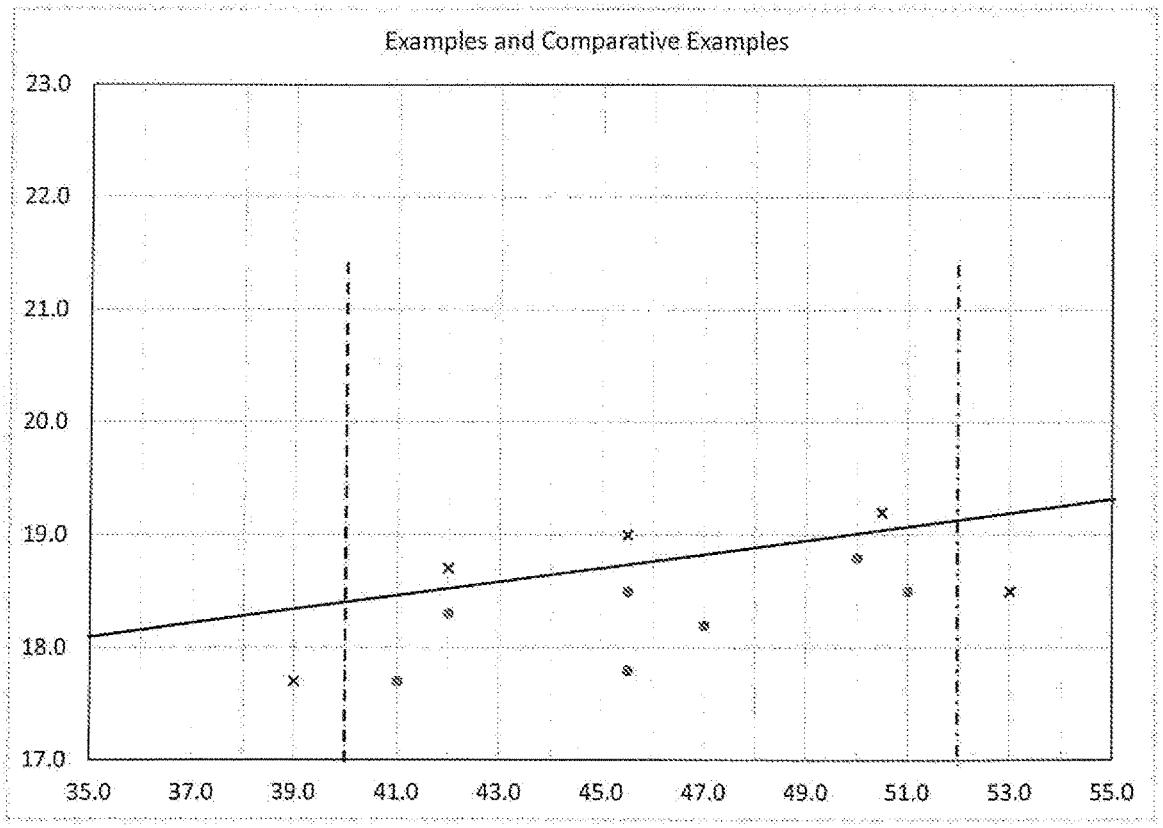
FIG. 5 is a scatter graph on which Examples 1 to 7 and Comparative Examples 1 to 5 are plotted.

The SS height Hs is preferably lower than a predetermined value, and this predetermined value is influenced by the face height Hf. The predetermined value is set to be greater as the face height Hf becomes greater, which makes the distance between the sweet spot SS and the face center Fc appropriate, thereby enabling to improve rebound performance at actual hitting points. Therefore, the coefficient of Hf in the expression 1 is a positive value, 0.06. In an orthogonal coordinate system having Hf as the horizontal axis and Hs as the vertical axis, the expression 1 indicates a region lower than a straight line having a gradient of 0.06 and an intercept on the vertical axis of 16. This straight line is shown in FIG. 5 described later.

If the face height Hf is too low, bending of the face portion becomes small and the COR is reduced. In this regard, the face height Hf is preferably greater than or equal to 40 mm, more preferably greater than or equal to 41 mm, and even more preferably greater than or equal to 42 mm. As described above, in order to lower the position of the region having a high COR, it is effective to lower the sweet spot SS and lower the face center Fc. In this regard, the face height Hf is preferably less than or equal to 52 mm, more preferably less than or equal to 51 mm, and even more preferably less than or equal to 50 mm.

From the viewpoint of lowering the position of the region having a high COR, the vertical height Hc of the face center Fc is preferably less than or equal to 26 mm, more preferably less than or equal to 25 mm, and even more preferably less than or equal to 24 mm. From the viewpoint of increasing bending of the face portion, the vertical height Hc is preferably greater than or equal to 20 mm, more preferably greater than or equal to 21 mm, and even more preferably, greater than or equal to 22 mm.

From the viewpoint of lowering the position of the region having a high COR, the vertical height Hs of the sweet spot SS is preferably less than or equal to 21 mm, more preferably less than or equal to 20 mm, and even more preferably less than or equal to of 19 mm. If the height Hs is too small, the distance between the face center Fc and the sweet spot SS is excessively increased, which can degrade rebound performance. In this regard, the height Hs is preferably greater than or equal to 15 mm, more preferably greater than or equal to 16 mm, and even more preferably greater than or equal to 17 mm.

A COR value might vary depending on the position within the hitting face 102. The maximum value of COR values on the hitting face 102 is denoted by CORmax. An effective hitting area described later includes a measurement point of the CORmax.

The rules established by the USGA specify restrictions on rebound performance of iron heads. From the viewpoint of conformity to the rules, the CORmax is preferably less than or equal to a COR of a baseline plate which is specified in a COR measurement method described later. The COR of the baseline plate can be varied. From the viewpoint of increasing the possibility of conformity to the rules, the CORmax is preferably less than or equal to 0.840, more preferably less than or equal to 0.838, even more preferably less than or equal to 0.835, and yet even more preferably less than or equal to 0.830. By optimizing the relationship between the face height Hf and the SS height Hs, rebound performance at actual hitting points can be enhanced while suppressing the CORmax. From the viewpoint of wholly raising COR values in respective regions, the CORmax is preferably greater than or equal to 0.800, more preferably greater than or equal to 0.810, and even more preferably greater than or equal to 0.815.

From the viewpoint of rebound performance in the lower portion of the face, the sweet spot SS is preferably positioned on the sole side relative to the face center Fc. If the face center Fc is too far from the sweet spot SS toward the top side, it is difficult to lower the position of the high COR region. In this regard, the distance in the top-sole direction between the sweet spot SS and the face center Fc is preferably less than or equal to 7.0 mm, more preferably less than or equal to 6.5 mm, and even more preferably less than or equal to 6 mm. If the sweet spot SS is too close to the face center Fc, the sweet spot SS becomes high or the face height Hf becomes low, which also makes it difficult to lower the position of the high COR region. In this regard, the distance in the top-sole direction between the sweet spot SS and the face center Fc is preferably greater than or equal to 3.5 mm, more preferably greater than or equal to 4.0 mm, and even more preferably greater than or equal to 4.5 mm.

The distance in the top-sole direction between the sweet spot SS and the face center Fc can be rephrased by using SS-Y. The SS-Y is defined in the present disclosure, and corresponds to the Y coordinate of the sweet spot SS relative to that of the face center Fc. When the sweet spot SS is located on the lower side relative to the face center Fc, this SS-Y is a negative value. If the face center Fc is too far from the sweet spot SS toward the top side, it is difficult to lower the position of the high COR region. In this regard, the SS-Y is preferably greater than or equal to −7.0 mm, more preferably greater than or equal to −6.5 mm, and even more preferably greater than or equal to −6.0 mm. If the sweet spot SS is too close to the face center Fc, the sweet spot SS becomes high or the face height Hf becomes low, which also makes it difficult to lower the position of the high COR region. In this regard, the SS-Y is preferably less than or equal to −3.5 mm, more preferably less than or equal to −4.0 mm, and even more preferably less than or equal to −4.5 mm.

As described above, in the head 100, the face member p1 is attached to the head body h1. The face member p1 is a member different from the head body h1. The face member p1 and the head body h1 are formed separately from each other. As in the head 100, the weight 124 may be attached to the head body h1.

The specific gravity of the face member p1 is preferably smaller than the specific gravity of the head body h1. The light-weight face member p1 allows a saved weight to be generated. By allocating the saved weight to the lower portion of the head 100, the sweet spot SS can be lowered. From the viewpoint of the difference in the specific gravities, soft iron and stainless steel are preferably used as the material of the head body h1. Considering also formability, the stainless steel is more preferable. From the viewpoint of the difference in the specific gravities, pure titanium, a titanium alloy, and an aluminum alloy are preferably used as the material of the face member p1. Considering also strength, the titanium alloy is more preferable. When the head body h1 includes the weight 124, the specific gravity of the weight 124 is preferably greater than the specific gravity of the head body h1.

A double-pointed arrow L1 in FIG. 2 indicates a face length. The face length is the distance between a heel-side end of the longest face line gv1 and a toe-side end of the head 100. The face length L1 is measured along the toe-heel direction.

From the viewpoint of suitability to a standard effective hitting area (described later), the face length L1 is preferably greater than or equal to 68 mm, more preferably greater than or equal to 70 mm, and even more preferably greater than or equal to 72 mm. From the viewpoint of suitability to the standard effective hitting area, the face length L1 is preferably less than or equal to 80 mm, more preferably less than or equal to 78 mm, and even more preferably less than or equal to 76 mm.

In the head being in the reference state described above, the distance from the hosel end surface 111 to an intersection point between the center line CL1 of the hosel hole 110 and the horizontal plane GL is defined as a neck length L2 (see FIG. 2). From the viewpoint of lowering the sweet spot SS, the neck length L2 is preferably less than or equal to 60 mm, more preferably less than or equal to 58 mm, and even more preferably less than or equal to 56 mm. From the viewpoint of ensuring a contact area between the shaft and the hosel hole 110, the neck length L2 is preferably greater than or equal to 40 mm, more preferably greater than or equal to 45 mm, and even more preferably greater than or equal to 50 mm.

Both the face height Hf and the neck length L2 affect the position of the head gravity center G. By appropriately setting the neck length L2 (mm) with respect to the face height Hf (mm), the positional relationship between the face center Fc and the sweet spot SS can be set within a desirable scope. In this regard, L2/Hf is preferably less than or equal to 1.3, more preferably less than or equal to 1.28, and even more preferably less than or equal to 1.25. From the same viewpoint, L2/Hf is preferably greater than or equal to 1.1, more preferably greater than or equal to 1.12, and even more preferably greater than or equal to 1.14.

A double-pointed arrow T1 in FIG. 3 indicates a head thickness. The head thickness T1 is measured at the same toe-heel direction position as the face center Fc. A reference symbol s1 in FIG. 3 indicates a contact point between a straight line SL1 parallel to the hitting face 102 and the cross-sectional diagram of the head 100. The contact point s1 is a contact point between a back end of the head 100 and the straight line SL1 in the cross-sectional view of FIG. 3. The head thickness T1 is the distance between the hitting face 102 and the contact point s1. The head thickness T1 is measured along the direction perpendicular to the hitting face 102.

From the viewpoint of lowering the sweet spot SS, the head thickness T1 is preferably greater than or equal to 25 mm, more preferably greater than or equal to 26 mm, and even more preferably greater than or equal to 27 mm. From the viewpoint that the sweet spot SS should not be too far from the face center Fc, the head thickness T1 is preferably less than or equal to 33 mm, more preferably less than or equal to 32 mm, and even more preferably less than or equal to 31 mm.

A double-pointed arrow T2 in FIG. 3 indicates a blade width. The blade width T2 is measured at the same toe-heel direction position as the face center Fc. A reference symbol s2 in FIG. 3 indicates an intersection point between the back surface of the head 100 and a straight line SL2 which passes the upper end of the hitting face 102 and is perpendicular to the hitting face 102. The blade width T2 is the distance between the hitting face 102 and the intersection point s2. The blade width T2 is measured along the direction perpendicular to the hitting face 102.

From the viewpoint of lowering the sweet spot SS, the blade width T2 is preferably less than or equal to 10 mm, more preferably less than or equal to 9 mm, and even more preferably less than or equal to 8 mm. From the viewpoint that the sweet spot SS should not be too far from the face center Fc, the blade width T2 is preferably greater than or equal to 5 mm, more preferably greater than or equal to 6 mm, and even more preferably greater than or equal to 7 mm.

A double-pointed arrow W1 in FIG. 3 indicates a sole width. The sole width W1 is measured at the same toe-heel direction position as the face center Fc. A reference symbol s3 in FIG. 3 indicates a frontmost point of the head 100. The sole width W1 is the distance between the frontmost point s3 and the contact point s1. The sole width W1 is measured along the face-back direction. Note that the frontmost point s3 is a leading edge Le.

From the viewpoint of lowering the sweet spot SS, the sole width W1 is preferably greater than or equal to 26 mm, more preferably greater than or equal to 27 mm, and even more preferably greater than or equal to 28 mm. From the viewpoint that the sweet spot SS should not be too far from the face center Fc, the sole width W1 is preferably less than or equal to 36 mm, more preferably less than or equal to 35 mm, and even more preferably less than or equal to 34 mm.

Both the face height Hf and the sole width W1 affect the position of the head gravity center G. By appropriately setting the sole width W1 (mm) with respect to the face height Hf (mm), the positional relationship between the face center Fc and the sweet spot SS can be set within a desirable scope. In this regard, W1/Hf is preferably less than or equal to 0.78, more preferably less than or equal to 0.77, and even more preferably less than or equal to 0.76. From the same viewpoint, W1/Hf is preferably greater than or equal to 0.60, more preferably greater than or equal to 0.61, and even more preferably greater than or equal to 0.62.

When the face height Hf is reduced to be less than or equal to 52 mm, the face center Fc is lowered. It is difficult to locate the sweet spot SS at a position lower than the lowered face center Fc. From the viewpoint of achieving this arrangement, the ratio of the sole width W1 (mm) to the neck length L2 (mm) is preferably great. Specifically, W1/L2 is preferably greater than or equal to 0.50, more preferably greater than or equal to 0.51, and even more preferably greater than or equal to 0.52. Considering design limitations, W1/L2 is preferably less than or equal to 0.65, more preferably less than or equal to 0.64, and even more preferably less than or equal to 0.63.

From the viewpoint of substantial identity of distributions of hitting points, the head 100 has a real loft angle of preferably less than or equal to 35°, more preferably less than or equal to 34°, and even more preferably less than or equal to 33°. From the viewpoint of ease of hitting with a club, the real loft angle of the head 100 is preferably greater than or equal to 17°, more preferably greater than or equal to 18°, and even more preferably greater than or equal to 19°.

[Expected COR]

As described above, the expected COR is the weighted average of CORs which is obtained by taking the distribution of hitting points into consideration. The expected COR indicates an average value of substantial CORs measured by performing actual hitting, and therefore is also referred to as an effective COR. The expected COR is the sum total of values obtained by multiplying hitting probabilities in respective positions or zones on the hitting face by respectively corresponding COR values in the respective positions or zones. That is, the expected COR is calculated based on the following expression 2.

$$\text{expected } COR = \sum_{i=1}^{n} \sum_{j=1}^{m} p_{ij} * c_{ij} \qquad \text{(expression 2)}$$

In the expression 2, $p_{ij}$ indicates a hitting probability in a position (i,j) or a zone (i,j) within the effective hitting area, and $c_{ij}$ indicates a COR value in the position (i,j) or the zone (i,j). In addition, "i" corresponds to the position (coordinate) in the top-sole direction and "j" corresponds to the position (coordinate) in the toe-heel direction.

The effective hitting area is a part or the entirety of the hitting face 102. The effective hitting area can be appropriately set so that the expected COR substantially indicates the weighted average of the CORs at actual hitting points. Preferably, the effective hitting area has a centroid at a point Mc which is located at the same toe-heel direction position as the face center Fc and is separated by S mm from the leading edge Le (see FIG. 4 described later). Preferably, the point Mc is positioned on the sole side relative to the face center Fc. The effective hitting area may have a rectangular shape or may have any other shape. The effective hitting area may encompass almost the entire distributed region of hitting points obtained through actual hitting by a target golfer. A region that substantially causes missed hit may be excluded from the effective hitting area. In addition, a region where the hitting probability is zero may be excluded from the effective hitting area.

In the case of an iron head, a region surrounded by a rectangular having dimensions of ±17.5 mm in the toe-heel direction and ±12.5 mm in the top-sole direction with respect to the centroid Mc can be the effective hitting area, for example. In this disclosure, this rectangular region is also referred to as a standard effective hitting area. In the standard effective hitting area, the distance S of the centroid Mc is set to 16 mm. This point Mc is the substantial center of the distributed region of hitting points. The distance S is measured along the top-sole direction.

The effective hitting area can be divided into n×m zones by grid lines that divide the top-sole direction width of the effective hitting area into n equal parts and divide the toe-heel direction width of the effective hitting area into m equal parts. In this case, a zone (i,j) means a zone located on the i-th row from the top side and the j-th column from the toe side. In the standard effective hitting area, the grid lines can consist of straight lines drawn along the top-sole direction at intervals of 5 mm and straight lines drawn along the toe-heel direction at intervals of 5 mm. In this case, the n is 5, and the m is 7.

In the present disclosure, each of zones (i,j) is also referred to as a "bin". The effective hitting area can be an aggregate of a plurality of bins. In the standard effective hitting area, each of the bins, i.e., each zone (i,j), can be a square zone that has a toe-heel direction width of 5 mm and a top-sole direction with of 5 mm.

The hitting probability $p_{ij}$ can be determined based on the distribution of hitting points in actual hitting. The distribution of hitting points can be produced by summing up data of hitting points obtained from a plurality of golfers, for example. Further, distributions of hitting points may be produced for different types of golfers. The golfers may be classified based on handicaps, head speeds, etc. The ratio of the number of hits in the zone (i,j) to the total number of hits can be the hitting probability $p_{ij}$. By calculating the hitting probability $p_{ij}$ for each bin, a hitting probability matrix is obtained. The real loft angle of heads used for obtaining the data of hitting points to calculate the hitting probability matrix is preferably greater than or equal to 20° and less than or equal to 35°. The distributions of hitting points of the heads having a real loft angle of within this scope are similar.

The hitting probability $p_{ij}$ may be calculated by using a probability density function such as normal distribution. For example, the hitting probability $p_{ij}$ obtained from the distribution of hitting points in actual hitting may be modified by using the probability density function. This modification is effective when the total number of hits is small. Without performing actual hitting, the distribution of hitting points may be obtained through simulation, and the hitting probability $p_{ij}$ may be determined based on the result of the simulation.

In the case where the effective hitting area is divided into n×m bins by the grid lines, an aggregate of the hitting probabilities $p_{ij}$ in the respective bins is represented by a table having n rows and m columns. This table is an example of the hitting probability matrix. In this hitting probability matrix, the hitting probability in the zone (i,j) is indicated in a cell located on the i-th row from the top and the j-th column from the left. Specific examples of the hitting probability matrix will be described later.

In the case where the effective hitting area is divided into n×m bins by the grid lines, an aggregate of the values $c_{ij}$ in the respective bins is represented by a table having n rows and m columns. This table is an example of a COR matrix. In this COR matrix, the COR value in the zone (i,j) is indicated in a cell located on the i-th row from the top and the j-th column from the left. This COR matrix corresponds to the hitting probability matrix. However, a cell corresponding to a bin in which the hitting probability is zero is not necessarily required. Specific examples of the COR matrix will be described later. Between the hitting probability matrix and the COR matrix, corresponding values which are in the same bin are multiplied by each other. The sum total of the values obtained through the multiplications is the expected COR.

The $c_{ij}$ is a COR value in the zone (i,j). The $c_{ij}$ may be a COR value measured at one point within the zone (i,j). For example, the $c_{ij}$ may be a COR value measured at the center of the zone (i,j). The $c_{ij}$ may be obtained from COR values measured at a plurality of points within the zone (i,j). For example, the $c_{ij}$ may be an average of the COR values measured at the plurality of points within the zone (i,j).

In the COR matrix, the sum total of all the values $c_{ij}$ may be 100% (1.00) or may be less than 100% (1.00).

Preferably, the COR value can be determined through a canon test conforming to a method that is specified by the SGA (United States Golf Association) for determining COR. The COR can be measured based on "Interim Procedure for Measuring the Coefficient of Restitution of an Iron Clubhead Relative to a Baseline Plate Revision 1.3 Jan. 1, 2006" specified by the USGA. Regarding a head produced with electronic data, a COR value can be obtained by simulating the USGA-specified test using the produced head.

The COR value may be converted from a CT value. In this case, the COR value can be calculated by using the CT value that is easy to measure. Examples of a relational expression between a COR value and a CT value includes the following expression. This relational expression, for example, enables conversion between a CT value and a COR value.

$$CT(\mu s)=(COR\ value-0.718)/0.000436$$

Note that the CT value is measured by a pendulum test. The pendulum test is described in detail in "Technical Description of the Pendulum Test" attached to "Notice To Manufacturers" issued by the USGA on Feb. 24, 2003. The unit of the CT value is μs. Note that "CT" is an abbreviation for "Characteristic Time".

Figure 4:
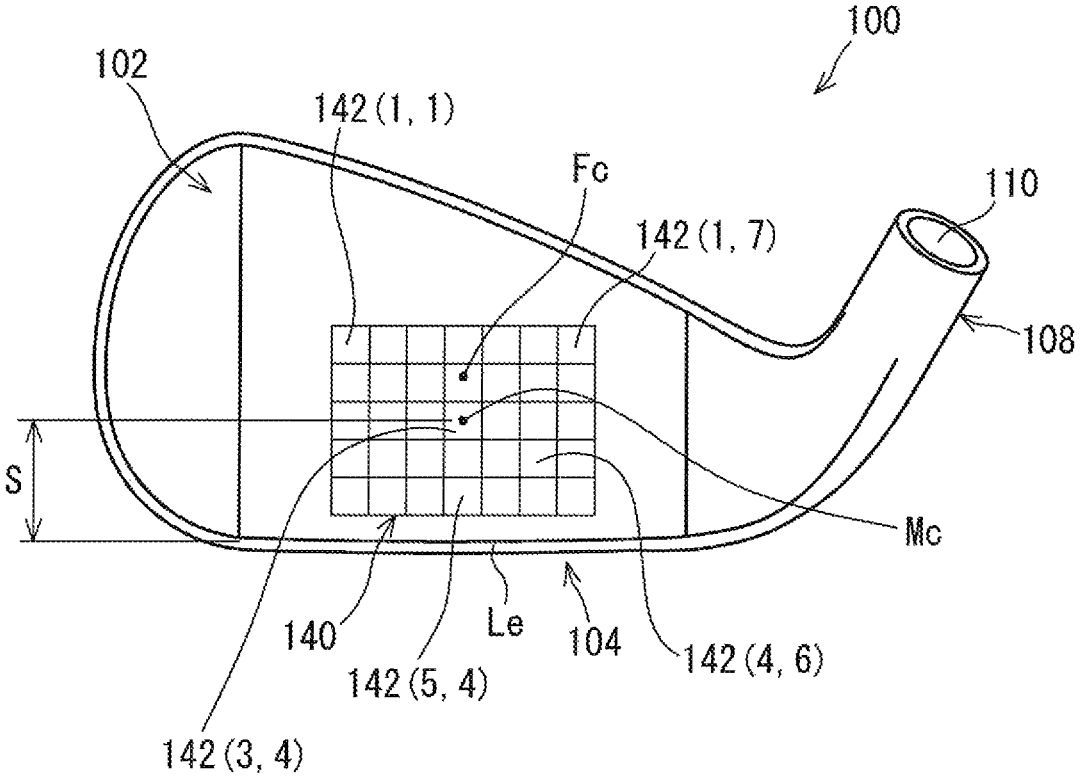
FIG. 4 shows an effective hitting area set on the head in FIG. 1.

FIG. 4 is a front view of the head 100, similar to FIG. 2. In FIG. 4, face lines gv are omitted.

The hitting face 102 of the head 100 includes an effective hitting area 140. In this embodiment, the standard effective hitting area described above is adopted as the effective hitting area 140. The effective hitting area 140 is divided into n×m zones by grid lines that divide the top-sole direction width of the effective hitting area 140 into n equal parts and divide the toe-heel direction width of the effective hitting area 140 into m equal parts. The grid lines consist of straight lines drawn along the top-sole direction at intervals of 5 mm, and straight lines drawn along the toe-heel direction at intervals of 5 mm. In this embodiment, the n is 5, and the m is 7. The entirety of the effective hitting area 140 is positioned on the front surface 120 of the face member p1.

The effective hitting area 140 has n×m bins 142. The effective hitting area 140 of the present embodiment has 35 (=5×7) bins 142. Each bin 142 is a square zone that has a toe-heel direction width of 5 mm and a top-sole direction width of 5 mm. As described above, for example, a bin 142 located on the toe-most side and the top-most side is the zone (1,1) that is, the row number i is 1 and the column number j is 1. FIG. 4 shows sets of two numerals in parentheses which indicate the row number i and the column number j in the form of (i,j) for some of the bins 142.

The face center Fc is positioned on the top side relative to the centroid Mc of the effective hitting area 140. In the present embodiment, the face center Fc is positioned in the zone (2,4). The effective hitting area 140 having dimensions of 25 m×35 mm substantially encompasses the entire hittable area, excluding a region that causes a missed hit. By setting the point Mc as the centroid of the effective hitting area 140, substantially the entire distributed area of the hitting points can be encompassed by the effective hitting area 140.

Table 1 is an example of the hitting probability matrix corresponding to the effective hitting area 140. Table 1 is produced based on the distribution of hitting points of advanced-level players having relatively high head speeds, and therefore is also referred to as an advanced-level players' standard hitting probability matrix. Twenty golfers have been subjected to measurement for the distribution of hitting points. The head speeds of these golfers are higher than or equal to 42 m/s and lower than or equal to 47 m/s. The total number of hits is 200.

Table 2 is another example of the hitting probability matrix corresponding to the effective hitting area 140. Table 2 is produced based on the distribution of hitting points of intermediate-level players having relatively low head speeds, and therefore is also referred to as an intermediate-level players' standard hitting probability matrix. Twenty golfers have been subjected to measurement for the distribution of hitting points. The head speeds of these golfers are higher than or equal to 35 m/s and lower than 42 m/s. The total number of hits is 200.

Table 3 is still another example of the hitting probability matrix corresponding to the effective hitting area 140. Table 3 is produced based on the distribution of hitting points of the advanced-level players and the intermediate-level players, and therefore is also referred to as an intermediate/advanced-level players' hitting probability matrix. Forty golfers have been subjected to measurement for the distribution of hitting points. The head speeds of these golfers are higher than or equal to 35 m/s and lower than or equal to 47 m/s. The total number of hits is 400.

TABLE 1

Advanced-level players' standard hitting probability matrix

| | | | | | | | |
|---|---|---|---|---|---|---|---|
| 0.4% | 0.4% | 0.3% | 0.0% | 0.1% | 0.0% | 0.0% | 10 mm toward top side |
| 3.5% | 2.7% | 1.8% | 1.8% | 0.9% | 0.6% | 0.0% | 5 mm toward top side |
| 4.4% | 10.0% | 8.5% | 7.3% | 4.1% | 2.0% | 0.8% | Center |
| 3.5% | 5.4% | 7.6% | 7.7% | 5.2% | 2.9% | 0.7% | 5 mm toward sole side |
| 1.4% | 2.8% | 4.2% | 3.8% | 3.2% | 1.7% | 0.4% | 10 mm toward sole side |
| 15 mm toward toe side | 10 mm toward toe side | 5 mm toward toe side | Center | 5 mm toward heel side | 10 mm toward heel side | 15 mm toward heel side | |

TABLE 2

Intermediate-level players' standard hitting probability matrix

| | | | | | | | |
|---|---|---|---|---|---|---|---|
| 0.0% | 0.0% | 0.0% | 1.1% | 0.0% | 0.0% | 0.0% | 10 mm toward top side |
| 0.0% | 1.1% | 2.9% | 0.6% | 0.6% | 0.6% | 0.0% | 5 mm toward top side |
| 5.2% | 4.0% | 8.0% | 6.9% | 3.4% | 2.9% | 1.1% | Center |
| 2.3% | 4.0% | 9.2% | 7.5% | 2.3% | 8.0% | 2.3% | 5 mm toward sole side |
| 4.0% | 3.4% | 1.7% | 4.6% | 5.7% | 5.2% | 1.1% | 10 mm toward sole side |
| 15 mm toward toe side | 10 mm toward toe side | 5 mm toward toe side | Center | 5 mm toward heel side | 10 mm toward heel side | 15 mm toward heel side | |

TABLE 3

Intermediate/advanced-level players' hitting probability matrix

| | | | | | | | |
|---|---|---|---|---|---|---|---|
| 0.2% | 0.2% | 0.1% | 0.6% | 0.0% | 0.0% | 0.0% | 10 mm toward top side |
| 1.7% | 1.9% | 2.4% | 1.2% | 0.7% | 0.6% | 0.0% | 5 mm toward top side |
| 4.8% | 7.0% | 8.3% | 7.1% | 3.8% | 2.4% | 1.0% | Center |
| 2.9% | 4.7% | 8.4% | 7.6% | 3.8% | 5.5% | 1.5% | 5 mm toward sole side |
| 2.7% | 3.1% | 3.0% | 4.2% | 4.5% | 3.4% | 0.8% | 10 mm toward sole side |
| 15 mm toward toe side | 10 mm toward toe side | 5 mm toward toe side | Center | 5 mm toward heel side | 10 mm toward heel side | 15 mm toward heel side | |

In Table 1 to Table 3, each $p_{ij}$ is represented in percentage. However, when the expected COR is actually calculated, the value $p_{ij}$ obtained as the hitting probability by the above-described manner is used as it is. For example, although $p_{11}$ in Table 1 is indicated as 0.4%, $p_{11}$ used for calculating the expected COR is 0.004.

For the sake of easy understanding, the positions of hitting points with respect to the centroid Mc are supplementally described in the hitting probability matrixes of Table 1 to Table 3.

Table 4 is an example of the COR matrix corresponding to the effective hitting area 140. Table 5 is another example of the COR matrix corresponding to the effective hitting area 140. These COR matrixes correspond to the hitting probability matrixes of Table 1 to Table 3. The expected COR can be calculated by using the hitting probability matrix and the COR matrix which correspond to each other.

TABLE 4

| Sample 1 of COR matrix | | | | | | | |
|---|---|---|---|---|---|---|---|
| 0.688 | 0.761 | 0.770 | 0.780 | 0.788 | 0.752 | — | 10 mm toward top side |
| 0.727 | 0.774 | 0.790 | 0.819 | 0.825 | 0.812 | 0.760 | 5 mm toward top side |
| 0.748 | 0.796 | 0.799 | 0.815 | 0.830 | 0.823 | 0.788 | Center |
| 0.715 | 0.732 | 0.754 | 0.781 | 0.793 | 0.796 | 0.771 | 5 mm toward sole side |
| 0.691 | 0.689 | 0.709 | 0.728 | 0.756 | 0.757 | 0.729 | 10 mm toward sole side |
| 15 mm toward toe side | 10 mm toward toe side | 5 mm toward toe side | Center | 5 mm toward heel side | 10 mm toward heel side | 15 mm toward heel side | |

TABLE 5

| Sample 2 of COR matrix | | | | | | | |
|---|---|---|---|---|---|---|---|
| 0.741 | 0.763 | 0.762 | 0.781 | 0.790 | 0.753 | — | 10 mm toward top side |
| 0.751 | 0.774 | 0.790 | 0.819 | 0.814 | 0.797 | 0.768 | 5 mm toward top side |
| 0.763 | 0.779 | 0.817 | 0.824 | 0.816 | 0.804 | 0.785 | Center |
| 0.755 | 0.777 | 0.788 | 0.797 | 0.792 | 0.791 | 0.777 | 5 mm toward sole side |
| 0.740 | 0.759 | 0.759 | 0.746 | 0.758 | 0.746 | 0.695 | 10 mm toward sole side |
| 15 mm toward toe side | 10 mm toward toe side | 5 mm toward toe side | Center | 5 mm toward heel side | 10 mm toward heel side | 15 mm toward heel side | |

Each of the values described in the COR matrixes of Table 4 and Table 5 is a COR value actually measured at the center point of each bin 142. Note that, in the COR matrixes of Table 4 and Table 5, a cell located on the 1st row and the 7th column, i.e., $c_{17}$, is blank. Such a COR matrix is applicable to a hitting probability matrix in which $p_{17}$ is zero.

As described above, when the face height Hf and the SS height Hs have a relationship that satisfies the above-described expression 1, the CORs at the actual hitting points are increased. In this regard, the expected COR is preferably greater than or equal to 0.740, more preferably greater than or equal to 0.750, and even more preferably greater than or equal to 0.760. Considering restriction on the $COR_{max}$ by the golf rules, the expected COR can be less than or equal to 0.830, further can be less than or equal to 0.820, and still further can be less than or equal to 0.810.

Preferably, the expected COR is calculated by using the advanced-level players' standard hitting probability matrix shown in Table 1. In this case, the distribution of hitting points of the advanced-level players is reflected, whereby an effective COR is obtained.

Preferably, the expected COR is calculated by using the intermediate-level players' standard hitting probability matrix shown in Table 2. In this case, the distribution of hitting points of the intermediate-level players is reflected, whereby an effective COR is obtained.

Preferably, the expected COR is calculated by using the intermediate/advanced-level players' hitting probability matrix shown in Table 3. In this case, the distribution of hitting points of the intermediate-level players and the advanced-level players is reflected, whereby an effective COR is obtained.

EXAMPLES

Example 1

A head that was the same as the head 100 described above was produced. The face member p1 was produced by subjecting a rolled material to NC machining. The material of the face member p1 was a titanium alloy. The head body h1 was produced by casting (lost-wax precision casting). The material of the head body h1 was stainless steel. The weight 124 and the cover 126 were attached to the head body h1 to obtain the head of Example 1. The cover 126 was welded to the head body h1.

An effective hitting area 140 (FIG. 4) was set on the obtained head. The standard effective hitting area described above was adopted as the effective hitting area 140. CORs were measured at the center points of the respective bins 142 to obtain a COR matrix. The COR measurement was performed in accordance with the above-described method specified by the USGA. The COR matrix of Example 1 was as shown in Table 5. An expected COR was obtained based on the COR matrix and the intermediate-level players' standard hitting probability matrix (Table 2). The specifications and evaluation results of Example 1 are shown in below Table 6.

Examples 2 to 7

Heads of Examples 2 to 7 were obtained in the same manner as Example 1 except that the specifications shown in Table 6 were adopted. In all the Examples, respective expected CORs were calculated by using the intermediate-level players' standard hitting probability matrix (Table 2). The specifications and evaluation results of these Examples are shown in below Table 6.

Comparative Examples 1 to 5

Heads of Comparative Examples 1 to 5 were obtained in the same manner as Example 1 except that the specifications shown in Table 7 were adopted. In all the Comparative Examples, respective expected CORs were calculated by using the intermediate-level players' standard hitting probability matrix (Table 2). The specifications and evaluation results of these Comparative Examples are shown in below Table 7.

TABLE 6

| Specifications and evaluation results of Examples | | | | | | | | |
|---|---|---|---|---|---|---|---|---|
| | Unit | Ex.1 | Ex.2 | Ex.3 | Ex.4 | Ex.5 | Ex.6 | Ex.7 |
| Face height Hf | mm | 45.5 | 47.0 | 45.5 | 50.0 | 42.0 | 41.0 | 51.0 |
| Vertical height Hs of sweet spot SS | mm | 17.8 | 18.2 | 18.5 | 18.8 | 18.3 | 17.7 | 18.5 |
| Vertical height Hc of face center | mm | 22.4 | 23.6 | 22.4 | 25.0 | 20.5 | 20.0 | 25.0 |
| SS-Y | mm | −4.8 | −5.9 | −3.6 | −6.3 | −3.5 | −3.5 | −6.4 |
| CORmax | — | 0.824 | 0.820 | 0.831 | 0.838 | 0.812 | 0.810 | 0.838 |
| Expected COR | — | 0.782 | 0.775 | 0.770 | 0.765 | 0.760 | 0.763 | 0.772 |

TABLE 7

| Specifications and evaluation results of Comparative Examples | | | | | | |
|---|---|---|---|---|---|---|
| | Unit | Com. Ex.1 | Com. Ex.2 | Com. Ex.3 | Com. Ex.4 | Com. Ex.5 |
| Face height Hf | mm | 45.5 | 50.5 | 42.0 | 39.0 | 53.0 |
| Vertical height Hs of sweet spot SS | mm | 19.0 | 19.2 | 18.7 | 17.7 | 18.5 |
| Vertical height Hc of face center | mm | 22.4 | 25.0 | 20.5 | 19.0 | 27.0 |
| SS-Y | mm | −3.6 | −4.8 | −3.1 | −2.5 | −7.5 |
| CORmax | — | 0.832 | 0.840 | 0.818 | 0.812 | 0.845 |
| Expected COR | — | 0.754 | 0.746 | 0.751 | 0.748 | 0.765 |

FIG. 5 is a graph (scatter graph) in which Examples 1 to 7 and Comparative Examples 1 to 5 are plotted. The graph of FIG. 5 has a horizontal axis that indicates the face height Hf (mm) and a vertical axis that indicates the vertical height Hs (mm) of the sweet spot SS. Examples 1 to 7 were plotted with black dots, and Comparative Examples 1 to 5 were plotted with "x". In FIG. 5, a solid line indicates a straight line of "Hs=0.06*Hf+16", a dashed line indicates a straight line of "Hf=40.0", and a one-dot chain line indicates a straight line of "Hf=52.0".

As shown in Table 6, in Examples 1 to 7, the values of the expected COR were high although the values of the CORmax were not high. Since the COR values in the zones having a high hitting probability were high, the expected COR was increased. Meanwhile, as shown in Table 7, in Comparative Examples 1 to 5, since the COR values in the zones having a high hitting probability were low, the expected COR was low. In Comparative Example 5, the expected COR was low despite its significantly high CORmax. In addition, the CORmax of Comparative Example 5 exceeded the limitation in the golf rules.

Thus, Examples are superior in rebound performance at actual hitting points to Comparative Examples.

Regarding the above-described embodiment, the following clauses are disclosed.

Clause 1

An iron type golf club head comprising a hitting face, wherein the hitting face includes a face center and a sweet spot, the hitting face has a face height that is denoted by Hf (mm), the face height Hf being measured at a toe-heel direction position of the face center, the sweet spot has a vertical height that is denoted by Hs (mm), the face center has a vertical height that is denoted by Hc (mm), the vertical height Hc is greater than or equal to 20 mm and less than or equal to 26 mm, the face height Hf is greater than or equal to 40 mm and less than or equal to 52 mm, and the head satisfies expression 1 shown below:

$$Hs<0.06*Hf+16 \quad \text{(expression 1).}$$

Clause 2

The iron type golf club head according to clause 1 further comprising a head body and a face member attached to the head body, wherein the face member has a specific gravity that is smaller than a specific gravity of the head body.

Clause 3

The iron type golf club head according to clause 1 or 2, wherein an expected COR is greater than or equal to 0.740, the expected COR being a sum total of values obtained by multiplying hitting probabilities in respective positions or zones on the hitting face by respectively corresponding COR values in the respective positions or zones.

Clause 4

The iron type golf club head according to any one of clauses 1 to 3, wherein a CORmax is less than or equal to 0.840, the CORmax being a maximum COR value.

Clause 5

The iron type golf club head according to any one of clauses 1 to 4, wherein the sweet spot is positioned on a sole side relative to the face center, and a distance in a top-sole direction between the sweet spot and the face center is greater than or equal to 3.5 mm and less than or equal to 7 mm.

The above description is merely an example, and various changes can be made without departing from the essence of the present disclosure.

What is claimed is:

1. An iron type golf club head comprising a hitting face, a hosel, and a sole, wherein the hitting face includes a face center and a sweet spot, the hitting face has a face height that is denoted by Hf (mm), the face height Hf being measured along the hitting face at a toe-heel direction position of the face center, the sweet spot has a vertical height that is denoted by Hs (mm), the face center has a vertical height that is denoted by Hc (mm), the vertical height Hc is greater than or equal to 20 mm and less than or equal to 26 mm, the face height Hf is greater than or equal to 40 mm and less than or equal to 52 mm, and the head satisfies expression 1 shown below:

$$Hs<0.06*Hf+16 \quad \text{(expression 1)},$$

wherein the vertical height Hs of the sweet spot is greater than or equal to 16 mm and less than or equal to 20 mm.

2. The iron type golf club head according to claim 1 further comprising a head body and a face member attached to the head body, wherein the face member has a specific gravity that is smaller than a specific gravity of the head body.

3. The iron type golf club head according to claim 1, wherein an expected COR is greater than or equal to 0.740, the expected COR being a sum total of values obtained by multiplying hitting probabilities in respective positions or zones on the hitting face by respectively corresponding COR values in the respective positions or zones.

4. The iron type golf club head according to claim 3, wherein an effective hitting area is set on a part of the hitting face, and the expected COR is a sum total of values obtained by multiplying hitting probabilities in respective positions or zones of the effective hitting area by respectively corresponding COR values in the respective positions or zones of the effective hitting area.

5. The iron type golf club head according to claim 4, wherein the effective hitting area has a centroid that is located on a toe-heel direction position coinciding with the toe-heel direction position of the face center.

6. The iron type golf club head according to claim 4, wherein the effective hitting area has a centroid that is positioned on a sole side relative to the face center.

7. The iron type golf club head according to claim 1, wherein a CORmax is less than or equal to 0.840, the CORmax being a maximum COR value.

8. The iron type golf club head according to claim 1, wherein the sweet spot is positioned on a sole side relative to the face center, and a distance in a top-sole direction between the sweet spot and the face center is greater than or equal to 3.5 mm and less than or equal to 7 mm.

9. The iron type golf club head according to claim 1, wherein the hitting face includes a longest face line, a distance between a heel-side end of the longest face line and a toe-side end of the head is defined as a face length, and the face length is greater than or equal to 68 mm and less than or equal to 80 mm.

10. An iron type golf club head comprising a hitting face, a hosel, and a sole, wherein the hitting face includes a face center and a sweet spot, the hitting face has a face height that is denoted by Hf (mm), the face height Hf being measured along the hitting face at a toe-heel direction position of the face center, the sweet spot has a vertical height that is denoted by Hs (mm), the face center has a vertical height that is denoted by Hc (mm), the vertical height Hc is greater than or equal to 20 mm and less than or equal to 26 mm, the face height Hf is greater than or equal to 40 mm and less than or equal to 52 mm, and the head satisfies expression 1 shown below:

$$Hs<0.06*Hf+16 \quad \text{(expression 1)},$$

wherein the hosel includes a hosel hole and a hosel end surface, and in a reference state where the head is placed on a horizontal plane, a distance from the hosel end surface to an intersection point between a center line of the hosel hole and the horizontal plane is defined as a neck length L2, and the neck length L2 is greater than or equal to 40 mm and less than or equal to 60 mm, wherein a ratio L2/Hf of the neck length L2 to the face height Hf is greater than or equal to 1.1 and less than or equal to 1.3, wherein the sole has a sole width W1 that is measured at the toe-heel direction position of the face center, and a ratio W1/Hf of the sole width W1 to the face height Hf is greater than or equal to 0.60 and less than or equal to 0.78.

11. The iron type golf club head according to claim 10, wherein a ratio W1/L2 of the sole width W1 to the neck length L2 is greater than or equal to 0.50 and less than or equal to 0.65.

12. An iron type golf club head comprising a hitting face, a hosel, and a sole, wherein the hitting face includes a face center and a sweet spot, the hitting face has a face height that is denoted by Hf (mm), the face height Hf being measured along the hitting face at a toe-heel direction position of the face center, the sweet spot has a vertical height that is denoted by Hs (mm), the face center has a vertical height that is denoted by Hc (mm), the vertical height Hc is greater than or equal to 20 mm and less than or equal to 26 mm, the face height Hf is greater than or equal to 40 mm and less than or equal to 52 mm, and the head satisfies expression 1 shown below:

$$Hs<0.06*Hf+16 \quad \text{(expression 1)},$$

wherein the sole has a sole width W1 that is measured at the toe-heel direction position of the face center, and a ratio W1/Hf of the sole width W1 to the face height Hf is greater than or equal to 0.60 and less than or equal to 0.78.

13. An iron type golf club head comprising a hitting face, a hosel, and a sole, wherein the hitting face includes a face center and a sweet spot, the hitting face has a face height that is denoted by Hf (mm), the face height Hf being measured along the hitting face at a toe-heel direction position of the face center, the sweet spot has a vertical height that is denoted by Hs (mm), the face center has a vertical height that is denoted by Hc (mm), the vertical height Hc is greater than or equal to 20 mm and less than or equal to 26 mm, the face height Hf is greater than or equal to 40 mm and less than or equal to 52 mm, and the head satisfies expression 1 shown below:

$$Hs<0.06*Hf+16 \quad \text{(expression 1)},$$

wherein the hosel includes a hosel hole and a hosel end surface, in a reference state where the head is placed on a horizontal plane, a distance from the hosel end surface to an intersection point between a center line of the hosel hole and the horizontal plane is defined as a neck length L2, the sole has a sole width W1 that is measured at the toe-heel direction position of the face center, and a ratio W1/L2 of the sole width W1 to the neck length L2 is greater than or equal to 0.50 and less than or equal to 0.65.

* * * * *